US011703276B2

(12) United States Patent
Lupascu et al.

(10) Patent No.: US 11,703,276 B2
(45) Date of Patent: Jul. 18, 2023

(54) SYSTEM AND METHOD OF DE-BOTTLENECKING LNG TRAINS

(71) Applicant: ExxonMobil Technology and Engineering Company, Spring, TX (US)

(72) Inventors: Sorin T. Lupascu, Spring, TX (US); Yow-Yeen Lee, The Woodlands, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 6 days.

(21) Appl. No.: 17/447,345

(22) Filed: Sep. 10, 2021

(65) Prior Publication Data

US 2022/0003496 A1 Jan. 6, 2022

Related U.S. Application Data

(62) Division of application No. 16/192,366, filed on Nov. 15, 2018, now Pat. No. 11,143,453.

(Continued)

(51) Int. Cl.
*F25J 1/00* (2006.01)
*F25J 1/02* (2006.01)

(52) U.S. Cl.
CPC ..... *F25J 1/0022* (2013.01); *F25J 1/005* (2013.01); *F25J 1/0052* (2013.01); *F25J 1/0055* (2013.01); *F25J 1/0072* (2013.01); *F25J 1/0082* (2013.01); *F25J 1/0087* (2013.01); *F25J 1/0218* (2013.01); *F25J 1/0236* (2013.01); *F25J 1/0271* (2013.01);

(Continued)

(58) Field of Classification Search
CPC ..... F25J 1/0022; F25J 1/005; F25J 1/0052; F25J 1/0055; F25J 1/0072; F25J 1/0082; F25J 1/0087; F25J 1/0218; F25J 1/0236; F25J 1/0271; F25J 1/0274; F25J 1/0283; F25J 2220/64

See application file for complete search history.

(56) References Cited

U.S. PATENT DOCUMENTS 5,615,561 A 4/1997 Houshmand et al. ..... 62/611
6,324,867 B1 12/2001 Fanning et al. ..... 62/613

(Continued)

OTHER PUBLICATIONS

Pearsall, Robin et al. (2012) "Process: Design Innovation In Large Scale Gas Liquefaction,"*Middle East, Air Products and Chemicals, Inc. Doha*, pp. 344-351.

*Primary Examiner* — Ljiljana V. Ciric
(74) *Attorney, Agent, or Firm* — Vorys, Sater, Seymour and Pease LLP

(57) ABSTRACT

A system and method for producing liquefied natural gas (LNG) from a natural gas stream. Each of a plurality of LNG trains liquefies a portion of the natural gas stream to generate a warm LNG stream in a first operating mode, and a cold LNG stream in a second operating mode. A sub-cooling unit is configured to, in the first operating mode, sub-cool the warm LNG streams to thereby generate a combined cold LNG stream. The warm LNG streams have a higher temperature than a temperature of the cold LNG streams in the second operating mode and the combined cold LNG stream. The combined cold LNG stream has, in the first operating mode, a higher flow rate than the flow rate of the cold LNG streams in the second operating mode.

14 Claims, 3 Drawing Sheets

Related U.S. Application Data

(60) Provisional application No. 62/609,825, filed on Dec. 22, 2017.

(52) U.S. Cl.
CPC ..... *F25J 1/0274* (2013.01); *F25J 1/0283* (2013.01); *F25J 2220/64* (2013.01)

(56) References Cited

U.S. PATENT DOCUMENTS

| | | | | |
|---|---|---|---|---|
| 7,500,370 | B2 | 3/2009 | Coward | 62/657 |
| 7,526,926 | B2 | 5/2009 | Rasmussen et al. | 62/619 |
| 11,009,291 | B2 | 5/2021 | Christensen | |
| 11,105,553 | B2 * | 8/2021 | Victory | F25J 1/0212 |
| 11,143,453 | B2 * | 10/2021 | Lupascu | F25J 1/0271 |
| 11,536,510 | B2 * | 12/2022 | Liu | F25J 1/0278 |
| 2005/0056051 | A1 | 3/2005 | Roberts et al. | 62/612 |
| 2006/0283206 | A1 | 12/2006 | Rasmussen et al. | 62/619 |
| 2007/0193303 | A1 | 8/2007 | Hawrysz et al. | 62/612 |
| 2007/0227187 | A1 | 10/2007 | Coward | 62/862 |
| 2009/0282862 | A1 | 11/2009 | Chantant et al. | 62/614 |
| 2010/0319396 | A1 | 12/2010 | Dam et al. | 62/613 |
| 2011/0239699 | A1 * | 10/2011 | Kolscheid | F25J 1/0218 290/40 R |
| 2017/0191750 | A1 | 7/2017 | De Barros et al. | |
| 2018/0128543 | A1 | 5/2018 | Hodges et al. | |
| 2020/0340741 | A1 | 10/2020 | Calderon et al. | |
| 2021/0140707 | A1 | 5/2021 | Minigulov et al. | |

* cited by examiner

SYSTEM AND METHOD OF DE-BOTTLENECKING LNG TRAINS

CROSS REFERENCE TO RELATED APPLICATIONS

This application is a divisional of U.S. patent application Ser. No. 16/192,366 filed Nov. 15, 2018, which claims the priority benefit of U.S. Provisional Patent Application No. 62/609,825 filed Dec. 22, 2017 entitled SYSTEM AND METHOD OF DE-BOTTLENECKING LNG TRAINS, the entirety of which is incorporated by reference herein.

FIELD OF DISCLOSURE

The disclosure relates generally to the field of hydrocarbon processing plants. More specifically, the disclosure relates to the efficient design, construction and operation of hydrocarbon processing plants, such as LNG processing plants.

DESCRIPTION OF RELATED ART

This section is intended to introduce various aspects of the art, which may be associated with the present disclosure. This discussion is intended to provide a framework to facilitate a better understanding of particular aspects of the present disclosure. Accordingly, it should be understood that this section should be read in this light, and not necessarily as admissions of prior art.

LNG production is a rapidly growing means to supply natural gas from locations with an abundant supply of natural gas to distant locations with a strong demand for natural gas. The conventional LNG cycle includes: a) initial treatments of the natural gas resource to remove contaminants such as water, sulfur compounds and carbon dioxide; b) the separation of some heavier hydrocarbon gases, such as propane, butane, pentane, etc. by a variety of possible methods including self-refrigeration, external refrigeration, lean oil, etc.; c) refrigeration of the natural gas substantially by external refrigeration to form liquefied natural gas at or near atmospheric pressure and about −160° C.; d) removal of light components from the LNG such as nitrogen and helium; e) transport of the LNG product in ships or tankers designed for this purpose to a market location; and f) re-pressurization and regasification of the LNG at a regasification plant to form a pressurized natural gas stream that may be distributed to natural gas consumers.

In a time when competition for LNG production contracts is increasing, there is a tremendous need to enhance the profitability of future LNG projects. To do so, LNG producers may identify and optimize the key cost drivers and efficiencies applicable to each project. One aspect of LNG train design is de-bottlenecking. Surpluses of inexpensive natural gas makes increasing LNG production from existing LNG trains very advantageous. However, large LNG trains are already frequently operated at or above nameplate capacity, meaning there is little additional production capacity available without constructing additional trains. As this requires very high capital expenditures, there is a need for a way to increase LNG production while minimizing new construction costs.

SUMMARY

In one aspect, a system for producing liquefied natural gas (LNG) from a natural gas stream is provided. A first LNG train is configured to liquefy a first portion of the natural gas stream to generate a first warm LNG stream in a first operating mode, and a first cold LNG stream in a second operating mode. A second LNG train is configured to liquefy a second portion of the natural gas stream to generate a second warm LNG stream in the first operating mode, and a second cold LNG stream in the second operating mode. A sub-cooling unit is configured to, in the first operating mode, sub-cool the first warm LNG stream and the second warm LNG stream to generate a first cold LNG stream in the first operating mode and a second cold LNG stream in the first operating mode. The first and second warm LNG streams have a higher temperature than a temperature of the first and second cold LNG streams in the second operating mode. The first and second cold LNG streams, in the first operating mode, have a higher combined flow rate than the combined flow rate of the first and second cold LNG streams in the second operating mode.

In another aspect, a system for producing liquefied natural gas (LNG) from a natural gas stream is provided. The system includes a plurality of LNG trains. Each of the plurality of LNG trains is configured to liquefy a portion of the natural gas stream to generate a warm LNG stream in a first operating mode, and a cold LNG stream in a second operating mode. A sub-cooling unit is configured to, in the first operating mode, sub-cool the warm LNG streams generated by each of the plurality of LNG trains to thereby generate a combined cold LNG stream. The warm LNG streams have a higher temperature than a temperature of the cold LNG streams in the second operating mode and the combined cold LNG stream. The combined cold LNG stream has, in the first operating mode, a higher flow rate than the combined flow rate of the cold LNG streams in the second operating mode.

In yet another aspect, a method of producing liquefied natural gas (LNG) from a natural gas stream is provided. A plurality of LNG trains and a sub-cooling unit are provided. Using each of the plurality of LNG trains, a portion of the natural gas stream is liquefied to thereby generate a warm LNG stream in a first operating mode in each of the plurality of LNG trains, and a cold LNG stream in a second operating mode in each of the plurality of LNG trains. In the first operating mode, the warm LNG streams generated by each of the plurality of LNG trains are sub-cooled in the sub-cooling unit to thereby generate a combined cold LNG stream. The warm LNG streams have a higher temperature than a temperature of the cold LNG streams in the second operating mode and the combined cold LNG stream. The combined cold LNG stream has, in the first operating mode, a higher flow rate than the combined flow rate of the cold LNG streams in the second operating mode.

DESCRIPTION OF THE DRAWINGS

The present disclosure is susceptible to various modifications and alternative forms, specific exemplary implementations thereof have been shown in the drawings and are herein described in detail. It should be understood, however, that the description herein of specific exemplary implementations is not intended to limit the disclosure to the particular forms disclosed herein. This disclosure is to cover all modifications and equivalents as defined by the appended claims. It should also be understood that the drawings are not necessarily to scale, emphasis instead being placed upon clearly illustrating principles of exemplary embodiments of the present invention. Moreover, certain dimensions may be exaggerated to help visually convey such principles. Further where considered appropriate, reference numerals may be repeated among the drawings to indicate corresponding or analogous elements. Moreover, two or more blocks or elements depicted as distinct or separate in the drawings may be combined into a single functional block or element. Similarly, a single block or element illustrated in the drawings may be implemented as multiple steps or by multiple elements in cooperation. The forms disclosed herein are illustrated by way of example, and not by way of limitation, in the figures of the accompanying drawings and in which like reference numerals refer to similar elements and in which:

DETAILED DESCRIPTION

Terminology

Figure 1:
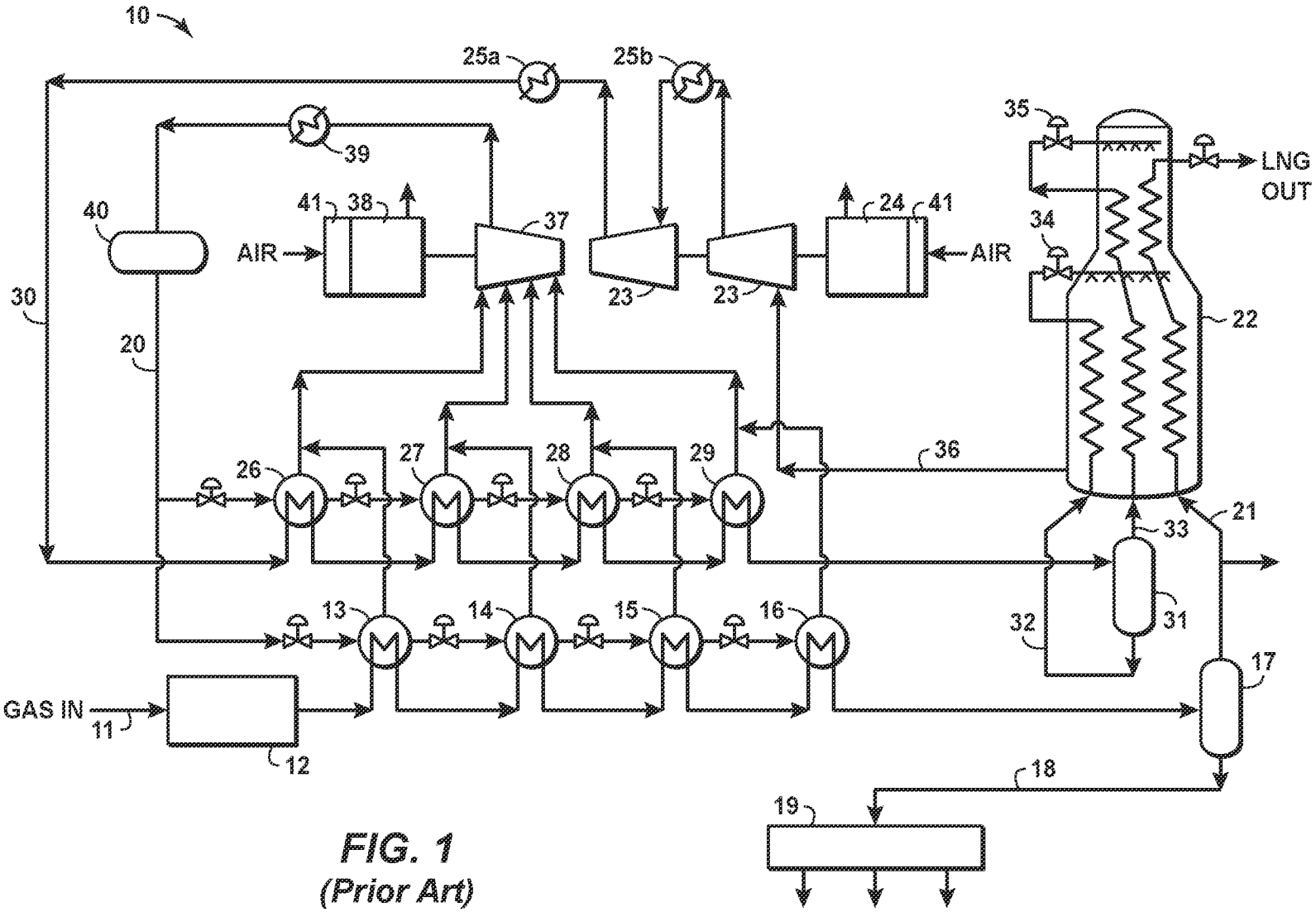
FIG. 1 (Prior Art)
FIG. 1 is a flow diagram of a system for producing liquefied natural gas (LNG) that may be used with aspects of the disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

A/an: The articles "a" and "an" as used herein mean one or more when applied to any feature in embodiments and implementations of the present invention described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

About: As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

And/or: The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of".

Any: The adjective "any" means one, some, or all indiscriminately of whatever quantity.

At least: As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Based on: "Based on" does not mean "based only on", unless expressly specified otherwise. In other words, the phrase "based on" describes both "based only on," "based at least on," and "based at least in part on."

Comprising: In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Couple: Any use of any form of the terms "connect", "engage", "couple", "attach", or any other term describing an interaction between elements is not meant to limit the interaction to direct interaction between the elements and may also include indirect interaction between the elements described.

Determining: "Determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

Embodiments: Reference throughout the specification to "one embodiment," "an embodiment," "some embodiments," "one aspect," "an aspect," "some aspects," "some implementations," "one implementation," "an implementation," or similar construction means that a particular component, feature, structure, method, or characteristic described in connection with the embodiment, aspect, or implementation is included in at least one embodiment and/or implementation of the claimed subject matter. Thus, the appearance of the phrases "in one embodiment" or "in an embodiment" or "in some embodiments" (or "aspects" or "implementations") in various places throughout the specification are not necessarily all referring to the same embodiment and/or implementation. Furthermore, the particular features, structures, methods, or characteristics may be combined in any suitable manner in one or more embodiments or implementations.

Exemplary: "Exemplary" is used exclusively herein to mean "serving as an example, instance, or illustration." Any embodiment described herein as "exemplary" is not necessarily to be construed as preferred or advantageous over other embodiments.

Flow diagram: Exemplary methods may be better appreciated with reference to flow diagrams or flow charts. While for purposes of simplicity of explanation, the illustrated methods are shown and described as a series of blocks, it is to be appreciated that the methods are not limited by the order of the blocks, as in different embodiments some blocks may occur in different orders and/or concurrently with other blocks from that shown and described. Moreover, less than all the illustrated blocks may be required to implement an exemplary method. In some examples, blocks may be combined, may be separated into multiple components, may employ additional blocks, and so on.

May: Note that the word "may" is used throughout this application in a permissive sense (i.e., having the potential to, being able to), not a mandatory sense (i.e., must).

Operatively connected and/or coupled: Operatively connected and/or coupled means directly or indirectly connected for transmitting or conducting information, force, energy, or matter.

Optimizing: The terms "optimal," "optimizing," "optimize," "optimality," "optimization" (as well as derivatives and other forms of those terms and linguistically related words and phrases), as used herein, are not intended to be limiting in the sense of requiring the present invention to find the best solution or to make the best decision. Although a mathematically optimal solution may in fact arrive at the best of all mathematically available possibilities, real-world embodiments of optimization routines, methods, models, and processes may work towards such a goal without ever actually achieving perfection. Accordingly, one of ordinary skill in the art having benefit of the present disclosure will appreciate that these terms, in the context of the scope of the present invention, are more general. The terms may describe one or more of: 1) working towards a solution which may be the best available solution, a preferred solution, or a solution that offers a specific benefit within a range of constraints; 2) continually improving; 3) refining; 4) searching for a high point or a maximum for an objective; 5) processing to reduce a penalty function; 6) seeking to maximize one or more factors in light of competing and/or cooperative interests in maximizing, minimizing, or otherwise controlling one or more other factors, etc.

Order of steps: It should also be understood that, unless clearly indicated to the contrary, in any methods claimed herein that include more than one step or act, the order of the steps or acts of the method is not necessarily limited to the order in which the steps or acts of the method are recited.

Ranges: Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, etc. and sub-ranges such as 10 to 50, 20 to 100, etc. Similarly, it should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

As used herein, the term "hydrocarbon" refers to an organic compound that includes primarily, if not exclusively, the elements hydrogen and carbon. Examples of hydrocarbons include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (20° C. and 1 atm pressure). Hydrocarbon fluids may include, for example, oil, natural gas, gas condensates, coal bed methane, shale oil, shale gas, and other hydrocarbons that are in a gaseous or liquid state.

Description

Specific forms will now be described further by way of example. While the following examples demonstrate certain forms of the subject matter disclosed herein, they are not to be interpreted as limiting the scope thereof, but rather as contributing to a complete description.

According to disclosed aspects, a method and system is provided that employs one or more de-bottlenecking strategies to two or more LNG trains. More specifically, production capacity of two or more existing LNG trains may be increased by configuring each LNG train for a warm LNG mode and installing one or more new sub-cooling units downstream. The design of the subcooling unit(s) and the size of the associated gas turbine driver(s) are matched to the known excess feed gas capacity available in the inlet and gas pre-treatment sections of the LNG plant (i.e., the LNG trains operationally connected to the sub-cooling units), plus any additional planned or anticipated debottlenecking.

Referring more particularly to the drawings, FIG. 1 illustrates a typical, known system 10 and process for liquefying natural gas (LNG). In system 10, feed gas (natural gas) enters through inlet line 11 into a preparation unit 12 where it is treated to remove contaminants. The treated gas then passes from unit 12 through a series of heat exchangers 13, 14, 15, 16, where it is cooled by evaporating propane which, in turn, is flowing through the respective heat exchangers through propane circuit 20. The cooled natural gas then flows to fractionation column 17 wherein pentanes and heavier hydrocarbons are removed through line 18 for further processing in fractionating unit 19.

The remaining mixture of methane, ethane, propane, and butane is removed from fractionation column 17 through line 21 and is liquefied in the main cryogenic heat exchanger 22 by further cooling the gas mixture with a mixed refrigerant which flows through a mixed refrigerant circuit 30. The mixed refrigerant is a mixture of nitrogen, methane, ethane, and propane which is compressed in compressors 23 which, in turn, are driven by gas turbine 24. After compression, the mixed refrigerant is cooled by passing it through air or water coolers 25*a*, 25*b* and is then partly condensed within heat exchangers 26, 27, 28, and 29 by the evaporating propane from propane circuit 20. The mixed refrigerant is then flowed to a high pressure mixed refrigerant separator 31 wherein the condensed liquid (line 32) is separated from the vapor (line 33). As seen in FIG. 1, both the liquid and vapor from separator 31 flow through main cryogenic heat exchanger 22 where they are cooled by evaporating mixed refrigerant.

The cold liquid stream in line 32 is removed from the middle of heat exchanger 22 and the pressure thereof is reduced across expansion valve 34. The now low pressure mixed refrigerant is then put back into exchanger 22 where it is evaporated by the warmer mixed refrigerant streams and the feed gas stream in line 21. When the mixed refrigerant vapor steam reaches the top of heat exchanger 22, it has condensed and is removed and expanded across expansion valve 35 before it is returned to the heat exchanger 22. As the condensed mixed refrigerant vapor falls within the exchanger 22, it is evaporated by exchanging heat with the feed gas in line 21 and the high pressure mixed refrigerant stream in line 32. At the middle of exchanger 22, the falling condensed mixed refrigerant vapor mixes with the low pressure mixed refrigerant liquid stream within the exchanger 22 and the combined stream exits the bottom exchanger 22 as a vapor through outlet 36 to flow back to compressors 23 to complete mixed refrigerant circuit 30.

Closed propane circuit 20 is used to cool both the feed gas and the mixed refrigerant before they pass through main cryogenic heat exchanger 22. Propane is compressed by compressor 37 which, in turn, is powered by gas turbine 38. The compressed propane is condensed in coolers 39 (e.g. seawater or air cooled) and is collected in propane surge tank 40 from which it is cascaded through the heat exchangers (propane chillers) 13-16 and 26-29 where it evaporates to cool both the feed gas and the mixed refrigerant, respectively. Both gas turbines 24 and 38 may include have air filters 41.

Figure 2:
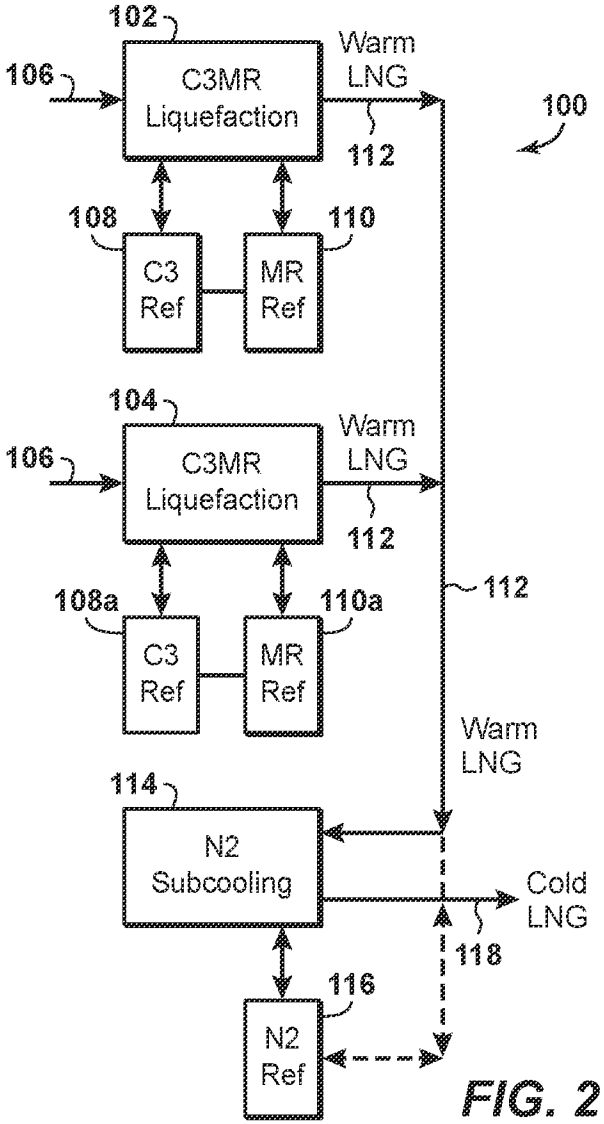
FIG. 2 is a schematic diagram of a system for producing LNG in a first operating mode according to aspects of the disclosure.

System 10 may be termed an LNG train, and may be combined with similar LNG trains, either in series or in parallel, to maximize LNG production. Such combination is shown in FIG. 2, which is a schematic diagram of an LNG plant according to an aspect of the disclosure. LNG plant 100 includes at least two LNG trains, and in FIG. 2 the LNG trains are represented by a first LNG train 102 and a second LNG train 104. Each LNG train is shown as using a propane refrigerant and a mixed refrigerant, in a propane refrigerant cycle and a mixed refrigerant cycle, respectively, to liquefy a supply of natural gas 106 as is known in the art. A propane cooling unit 108, 108*a* cools the propane refrigerant to a desired temperature, and a mixed refrigerant cooling unit 110, 110*a* cools the mixed refrigerant to another desired temperature, according to known principles. Each cooling unit may include one or more compressors, electric motors, heat exchangers, expanders, and/or gas turbines (not shown) to cool the respective refrigerant to the desired temperatures and pressures. The compositions of each of the refrigerants may vary according to design specifications and availability, and may comprise known propane refrigerant compositions and mixed refrigerant compositions, including those having fluorocarbons, noble gases, hydrocarbons, or the like.

In operation, each of the LNG trains 102, 104 liquefies a supply of natural gas 106 to a temperature between, for example about −100° C. and about −140° C., and to a pressure of between about 5 bara to about 70 bara or more, to produce a warm LNG stream 112. The warm LNG stream 112 is sent to a nitrogen subcooler 114, which uses a nitrogen refrigerant in a nitrogen subcooling cycle. A nitrogen subcooling unit 116 cools the nitrogen refrigerant to a desired temperature. Each cooling unit may include one or more compressors, electric motors, expanders, heat exchangers, and/or gas turbines (not shown) to cool the respective refrigerant to the desired temperatures and pressures. The composition of the subcooling refrigerant can be either pure nitrogen as mentioned here or another refrigerant of a varied composition according to design specifications and availability, and may comprise substantially all nitrogen, or a combination of nitrogen and other coolants. The nitrogen sub-cooling unit 116 sub-cools the warm LNG stream 112 to a temperature of, for example, about −155° C., and to a pressure of about 4 bara, thereby forming a cold LNG stream 118. At this temperature and pressure, the cold LNG stream 118 may be stored and/or transported as desired.

Figure 3:
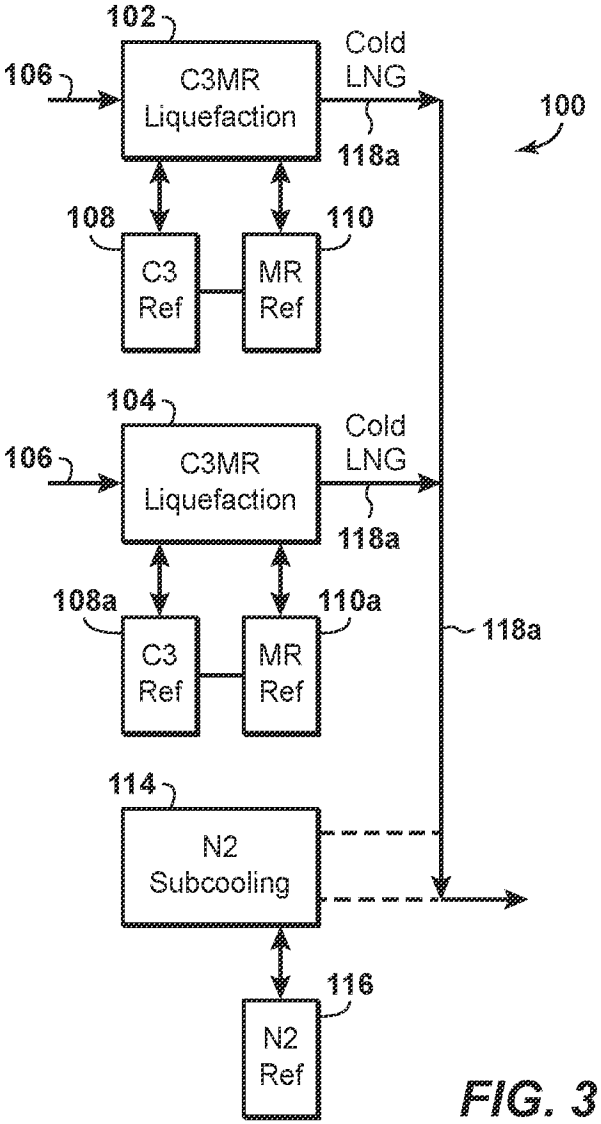
FIG. 3 is a schematic diagram of a system for producing LNG in a second operating mode according to aspects of the disclosure.

The LNG plant 100 may also be operated without the nitrogen subcooler 114, as depicted in FIG. 3. In this operating mode, which is similar to conventional operation of known LNG plants with parallel LNG trains, each of the LNG trains 102, 104 cools and sub-cools the natural gas stream 112 to a temperature of, for example, about −155° C., and to a pressure of about 4 bara, thereby forming a cold LNG stream 118*a*. Because the LNG trains are responsible to sub-cool the LNG without the nitrogen subcooling loop in operation, there is less LNG in the cold LNG stream 118*a* as compared to the cold LNG stream 118 in FIG. 2. It can be seen, then, that the addition of the nitrogen sub-cooler 114 to LNG plant increases the amount of LNG produced thereby, without the need for another LNG train. The nitrogen sub-cooler 114 may therefore serve as an effective LNG de-bottlenecking solution because the nitrogen sub-cooler is significantly less expensive to construct and maintain than another LNG train. Additionally, as nitrogen is a component in both the atmosphere and (perhaps even) the natural gas stream, the nitrogen used as the sub-coolant may be obtained from a nitrogen rejection unit (NRU), from the boil-off gas of an LNG storage tank, from liquid nitrogen (LIN) generated at an LNG regasification plant and transported to the LNG plant 100, or other means, thereby eliminating the need for additional supplies of propane refrigerant and/or mixed refrigerant.

Aspects of the disclosure may be varied in many ways while keeping with the spirit of the disclosure. For example, the cooling in the LNG trains 102, 104 and/or the nitrogen sub-cooler may include water-based cooling and/or air-based cooling, and the heat exchangers associated with the LNG subcooling may comprise spiral-wound heat exchangers, brazed aluminum heat exchangers, or other known types of heat exchangers. The nitrogen sub-cooler may include single-shaft, double-shaft, and/or multi-shaft gas turbines and/or electric motor drivers. The nitrogen sub-cooler may be built at the same time as the LNG trains (i.e., a greenfield installation), or may be built onto an existing LNG plant (i.e., a brownfield installation). In either case, the nitrogen sub-cooler may be combined with an end flash gas unit for additional debottlenecking potential. It may also be possible to further increase LNG production efficiency by installing an inlet air cooling system to be used with existing gas turbines in LNG trains 102, 104 and/or gas turbines in the nitrogen sub-cooler. The concept of inlet air cooling is more fully explained in commonly-owned U.S. Pat. No. 6,324,867 to Fanning, et al., the disclosure of which is incorporated by reference herein in its entirety. Additionally, while there are specific advantages to using nitrogen as the refrigerant in the sub-cooling unit 114, it may also be desirable to use other compositions in the sub-cooling unit, such as one or more of nitrogen, methane, propane, higher hydrocarbons, fluorocarbons, noble gases, and the like. Lastly, LNG trains 102, 104 have been described as using propane and mixed refrigerant to cool and liquefy natural gas, the nitrogen sub-cooling unit may be used with LNG trains using different refrigerants or combinations of refrigerants.

Figure 4:
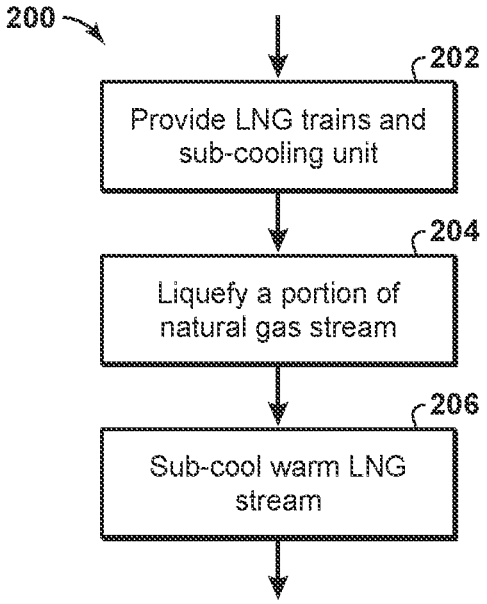
FIG. 4 is a flowchart of a method according to aspects of the disclosure.

FIG. 4 is a flowchart showing a method 200 of producing liquefied natural gas (LNG) from a natural gas stream according to disclosed aspects. At block 202 a plurality of LNG trains and a sub-cooling unit are provided. Using each of the plurality of LNG trains, at block 204 a portion of the natural gas stream is liquefied to thereby generate a warm LNG stream in a first operating mode in each of the plurality of LNG trains, and a cold LNG stream in a second operating mode in each of the plurality of LNG trains. At block 206, in the first operating mode, the warm LNG streams are sub-cooled in the sub-cooling unit to thereby generate a combined cold LNG stream. The warm LNG streams have a higher temperature than a temperature of the cold LNG streams in the second operating mode and the combined cold LNG stream. The combined cold LNG stream has, in the first operating mode, a higher flow rate than a flow rate of the cold LNG streams in the second operating mode.

An advantage of the disclosed aspects is that it is less expensive and faster to install than to construct an additional LNG train. Another advantage is that there are limited additional flare connections because nitrogen may be vented to atmosphere. Another advantage is that additional $C_2$ and/or $C_3$ (ethane and/or propane) refrigerant inventories are not needed. Still another aspect is that the LNG trains can operate in a pre-debottlenecking mode, albeit at a reduced capacity, when the disclosed sub-cooling loop is offline. Yet another advantage is that large nitrogen expanders (e.g., 10 MW, 15 MW, or up to 21 MW can be qualified and used). Still another advantage is that the sub-cooling unit can be built onsite (i.e., stickbuilt), partially modularized, or fully modularized. Such manufacturing flexibility may reduce time and cost of manufacturing.

INDUSTRIAL APPLICABILITY

The apparatus and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What we claim:

1. A system for producing liquefied natural gas (LNG) from a natural gas stream, comprising:

a plurality of LNG trains, each of the plurality of LNG trains configured to liquefy a portion of the natural gas stream to generate a warm LNG stream in a first operating mode in each of the plurality of LNG trains, and a cold LNG stream in a second operating mode in each of the plurality of LNG trains; and a sub-cooling unit configured to, in the first operating mode, sub-cool the warm LNG streams to thereby generate a combined cold LNG stream;

wherein the warm LNG streams have a higher temperature than a temperature of the cold LNG streams in the second operating mode and the combined cold LNG stream; and wherein the combined cold LNG stream has, in the first operating mode, a higher flow rate than the combined flow rate of the cold LNG streams in the second operating mode.

2. The system of claim 1, wherein the sub-cooling unit uses a nitrogen refrigerant to sub-cool the warm LNG streams.

3. The system of claim 1, wherein at least one of the plurality of LNG trains uses a propane refrigerant to liquefy the respective portions of the natural gas stream.

4. The system of claim 1, wherein at least one of the plurality of LNG trains uses a mixed refrigerant to liquefy the respective portions of the natural gas stream.

5. The system of claim 1, wherein at least one of the plurality of LNG trains uses a propane refrigerant and a mixed refrigerant to liquefy the respective portions of the natural gas stream, and wherein the sub-cooling unit uses a nitrogen refrigerant to sub-cool the warm LNG streams.

6. The system of claim 1, wherein the plurality of LNG trains have been in operation prior to installation of the sub-cooling unit.

7. The system of claim 1, wherein the plurality of LNG trains have not been in operation prior to installation of the sub-cooling unit.

8. A method of producing liquefied natural gas (LNG) from a natural gas stream, the method comprising:

providing a plurality of LNG trains and a sub-cooling unit;

using each of the plurality of LNG trains, liquefying a portion of the natural gas stream to thereby generate a warm LNG stream in a first operating mode in each of the plurality of LNG trains, and a cold LNG stream in a second operating mode in each of the plurality of LNG trains; and in the first operating mode, sub-cooling in the sub-cooling unit the warm LNG streams to thereby generate a combined cold LNG stream;

wherein the warm LNG streams have a higher temperature than a temperature of the cold LNG streams in the second operating mode and the combined cold LNG stream; and wherein the combined cold LNG stream has, in the first operating mode, a higher flow rate than the combined flow rate of the cold LNG streams in the second operating mode.

9. The method of claim 8, wherein the sub-cooling unit uses a nitrogen refrigerant to sub-cool the warm LNG stream.

10. The method of claim 8, wherein at least one of the plurality of LNG trains uses a propane refrigerant to liquefy the respective portions of the natural gas stream.

11. The method of claim 8, wherein at least one of the plurality of LNG trains uses a mixed refrigerant to liquefy the respective portions of the natural gas stream.

12. The method of claim 8, wherein at least one of the plurality of LNG trains uses a propane refrigerant and a mixed refrigerant to liquefy the respective portions of the natural gas stream, and wherein the sub-cooling unit uses a nitrogen refrigerant to sub-cool the warm LNG stream.

13. The method of claim 8, wherein the plurality of LNG trains are pre-existing LNG trains, and further comprising:

constructing the sub-cooling unit to be used with the existing LNG trains.

14. The method of claim 8, further comprising:

constructing the sub-cooling unit at substantially the same time as the plurality of LNG trains.

* * * * *